US006664995B2

(12) United States Patent
Milton et al.

(10) Patent No.: US 6,664,995 B2
(45) Date of Patent: Dec. 16, 2003

(54) LABEL MEDIA-SPECIFIC PLOTTER CUTTER DEPTH CONTROL

(75) Inventors: Scott C. Milton, Maplewood, MN (US); Daniel K. Workman, Zimmerman, MN (US)

(73) Assignee: Brady Worldwide, Inc., Milwaukee, WI (US)

( * ) Notice: Subject to any disclaimer, the term of this patent is extended or adjusted under 35 U.S.C. 154(b) by 128 days.

(21) Appl. No.: 09/683,717

(22) Filed: Feb. 6, 2002

(65) Prior Publication Data

US 2003/0146970 A1 Aug. 7, 2003

(51) Int. Cl.[7] ..... B41J 11/00; B41J 11/66

(52) U.S. Cl. ..... 347/218; 400/621

(58) Field of Search ..... 347/218, 176, 347/172, 174, 222; 400/621; 346/24

(56) References Cited

U.S. PATENT DOCUMENTS

| | | | | |
|---|---|---|---|---|
| 5,078,523 A | | 1/1992 | McGourty et al. | 400/613 |
| 5,138,341 A | | 8/1992 | Kobayashi | 346/136 |
| 5,157,761 A | | 10/1992 | Hawkes | 395/107 |
| 5,163,675 A | | 11/1992 | Sunohara | 271/274 |
| 5,188,009 A | | 2/1993 | Sunohara et al. | 83/13 |
| 5,202,958 A | | 4/1993 | Kobayashi | 395/102 |
| 5,275,077 A | | 1/1994 | Kobayashi | 83/880 |
| 5,318,370 A | | 6/1994 | Nehowig | 400/613 |
| 5,412,407 A | * | 5/1995 | Okubo et al. | 347/215 |
| 5,511,891 A | | 4/1996 | Nehowig et al. | 400/583 |

(List continued on next page.)

OTHER PUBLICATIONS

U.S. patent application Ser. No. 09/683,718, filed Feb. 6, 2002, pending.

Brochure—Brady® Make–It–Yourself Products, It's Important to use the Right Tool for the Right Job, Brady World-Wide, Inc., 1999.

Brochure—Brady® Graphic Solutions, GraphicsPro™ Label & Sign Creator Offers the Convenience of Custom Labels and Signs at the Touch of a Fingertip, W.H. Brady Co./Brady USA, Inc., 1997.

Brochure—Impressa 2 digital label & decal press, Pring and Cut Your Own Full–Color Labels and Decals in any Size or Shape!, pp. 1–6, Primera Technology, Inc., 1998.

Brochure—ColorCAMM PRO Versatility, Ronald DGA Corporation, 2000.

Brochure—The Future of Sign Making is here, Gerber Edge, Gerber Scientific Products, Inc., 1994.

*Primary Examiner*—Lamson Nguyen
*Assistant Examiner*—K. Feggins
(74) *Attorney, Agent, or Firm*—Whyte Hirschboeck Dudek SC

(57) ABSTRACT

Methods and systems are disclosed for controlling cutting depth of a label media such that the depth of cut is media-specific, that is, specific to the media being cut. The method includes: providing a plotter cutter and a force-generating mechanism; providing a memory device for electronic communication with the plotter cutter, the memory device having a label media-specific value stored thereon; reading the label media-specific value from the memory device; converting the label media-specific value to a label media-specific current signal; providing a label media-specific current based on the label media-specific current signal; applying the label media-specific current to a force-generating mechanism; generating a label media-specific cutting force based on the label media-specific current; and transferring the label media-specific cutting force to the plotter cutter to control plotter cutting at the label media-specific cutting depth. The methods and systems work towards eliminating waste or scrap plotter test cuts by plotter cutting a label media using information from, for example, a memory device associated with a label media supply. The methods and systems obviate the need for manual resetting of plotter cutter depth from one label media to another.

32 Claims, 8 Drawing Sheets

U.S. PATENT DOCUMENTS

| | | | | |
|---|---|---|---|---|
| 5,755,519 | A | 5/1998 | Klinefelter | 400/249 |
| 5,823,689 | A | 10/1998 | Nehowig et al. | 400/83 |
| 5,823,692 | A | 10/1998 | Tolrud et al. | 400/582 |
| 5,887,993 | A | 3/1999 | Nunokawa et al. | 400/208 |
| 6,002,416 | A * | 12/1999 | Gerber | 347/176 |
| 6,007,263 | A | 12/1999 | Imai et al. | 400/693 |
| 6,008,831 | A | 12/1999 | Nakanishi et al. | 347/195 |
| 6,034,705 | A | 3/2000 | Tolle et al. | 347/195 |
| 6,042,279 | A | 3/2000 | Ackley | 400/103 |
| 6,046,756 | A | 4/2000 | Iga et al. | 347/173 |
| 6,099,178 | A | 8/2000 | Spurr et al. | 400/207 |
| 6,112,658 | A | 9/2000 | Gunther et al. | 101/171 |
| 6,149,325 | A | 11/2000 | Nunokawa et al. | 400/208 |
| 6,201,256 | B1 | 3/2001 | Kouchi et al. | 250/559.44 |
| 6,213,659 | B1 | 4/2001 | Elgee | 400/633 |
| 6,246,050 | B1 | 6/2001 | Tullis et al. | 250/231.13 |
| 6,249,302 | B1 | 6/2001 | Sekiya | 347/220 |
| 6,264,296 | B1 | 7/2001 | Klinefelter et al. | 347/4 |
| 6,264,774 | B1 | 7/2001 | Lenz et al. | 156/64 |
| 6,266,075 | B1 | 7/2001 | Feitel et al. | 347/198 |
| D446,544 | S | 8/2001 | Platner et al. | D18/50 |
| 6,270,858 | B1 | 8/2001 | Paulson | 427/508 |
| 6,276,849 | B1 | 8/2001 | Feitel et al. | 400/242 |
| 6,339,982 | B1 * | 1/2002 | Angel et al. | 83/76.9 |
| 6,602,009 | B2 * | 8/2003 | Sodeyama | 400/621 |

* cited by examiner

LABEL MEDIA-SPECIFIC PLOTTER CUTTER DEPTH CONTROL

FIELD OF THE INVENTION

The present invention relates to cutting a label media. In one aspect, the invention relates to a method and system for automatically controlling plotter cutting depth when plotter cutting a label media. In another aspect, the present invention relates to a method and system for plotter cutting a label media.

BACKGROUND OF THE INVENTION

Electronic label printing machines are often used to generate adhesive labels having images (e.g., indicia, graphics, art, specialized instructions, warnings, slogans, advertising, etc.) to facilitate identification, tracking and pricing of goods. Such label printers typically include: a print head, an assembly (e.g., a label media cartridge) for supplying and feeding a label media past the print head in order to be printed, a microprocessor, a read-only memory (ROM) programmed with appropriate instructions therein to operate the microprocessor, a random access memory (RAM), a keyboard with letter, number, and function keys for entry of alphanumeric information requisite to printing the indicia on the label media, and a visual display such as a light emitting diode ("LED") or liquid crystal display ("LCD") screen to convey information to a machine operator. These components function together to achieve the end goal of creating high quality and accurate labels from the label media using the electronic label printing machine.

Labels are made from a label media. The label media itself typically is made up of a roll of pressure sensitive tape that is attached, typically along a side containing an adhesive, to a continuous support roll of release liner material. The label media is fed in a media direction along a media path through the label printer. Discrete labels are formed by cutting the label media. Complex label shapes can be obtained by plotter cutting the tape layer only of the label media. The label media can be end cut (i.e., cutting through the tape and the release liner layers) or portioned into an end cut label media portion in order to obtain as many discrete labels in a continuous row as is desired. In other words, one or more than one discrete label can reside on an end cut label media portion. An end cutting operation can occur with or without a plotter cutting operation first having taken place. Following label media cutting, the discrete labels can be removed from the release liner and attached, as appropriate, to the particular application requiring identification. Since there are many types of label applications, there are many combinations of tape and release liners that can provide labels of varying sizes, colors, formats, and characteristics.

One type of label printer employs a thermal transfer print head. In general, the use of thermal print heads in label printers has increased as the quality and accuracy of thermal print heads has improved. Thermal transfer printing uses a heat-generating print head to transfer an ink, or the like, from a thermal transfer ribbon to a label media to form a label image on the media. A microprocessor determines a sequence of individual thermal, typically resistive, print head elements to be selectively heated or energized. Energizing the sequence of elements in turn heats the ribbon so as to transfer the ink from the ribbon, creating the desired image on the label media, and specifically, on the label tape. The label printer can be fed label media from a label media cartridge. Simultaneously, a thermal transfer ribbon can be fed from a ribbon cartridge. While the label media runs between the print head and a support (platen) roller, the transfer ribbon can run between the print head and the support roller. Thus, the label media and the transfer ribbon can run together in an overlay relationship between the print head and the support roller.

When it is desired to print a color image on a label media, it is generally required to print the image by passing the label media several times past the print head. To accomplish each pass, the label media is fed, retracted, and then re-fed again past the thermal print head. With each pass, a different primary color, for example, in a traditional color scheme, cyan, magenta, yellow, and black, is printed from a continuous ink ribbon onto the label media using the print head. In this manner, based on the amount of each color printed, a composite color image can be printed onto a label media.

It is continually desirable to improve the functionality, performance and/or efficiency of various components, or combinations of components (also called "assemblies" or "subassemblies") that make up label printers. For example, it would be desirable to improve the process of plotter cutting in label printers.

Plotter cutting effects cutting of the tape layer of the label media only. Thus, to effect proper cutting, the plotter cutter knife or blade must cut a media at a cutting depth equal to, or substantially equal to, the tape layer thickness.

A given label media, and in particular, the tape layer of a given label media, can be made from a variety of materials, for example, plastic, vinyl, a combination of plastic and vinyl, paper, PET (polyethylene terephthalate)—sometimes metallized, magnetic material, among others. Each of these materials have varying characteristic properties (e.g., stiffness, density, etc.). Moreover, label media typically vary in size (e.g., media thickness, width, etc.). In order to avoid cutting, or substantially cutting, the label media release sheet layer when plotter cutting, a system or method ideally would account for, and provide plotter cutter control despite these variations in label media. Since plotter cutting systems typically cut many varieties or types of label media, it would be advantageous for a single plotter cutter to be able to adjust to, and therefore accommodate, the various label media, as they change from one label-making run to another.

To date, however, plotter cutting operations, systems and methods have been cumbersome, requiring significant amounts of post-manufacturer user intervention, both with respect to plotter cutting set-up (e.g., manually setting an initial plotter cutter knife or blade depth) in addition to adjustment time invested throughout the plotter cutting process. Specifically, monitoring and/or controlling, in addition to setting up, of plotter cutting has been characterized as a heavily manual process based on amounts of trial and error. This has resulted in significant labor costs, increased amounts of wasted materials, particularly when the label media is varied numerous times from one label run to another.

Thus, it would be desirable to provide a system and method for controlling plotter cutting that would reduce material waste, and eliminate, or substantially eliminate, much of the trial and error that has characterized plotter cutting. Such a method and system would substantially reduce user intervention in the plotter cutting process and require little, if any, user intervention.

SUMMARY OF INVENTION

The present invention generally provides a label printer plotter cutter that overcomes the aforementioned problems.

In one aspect, the present invention is directed to a method for making a media-specific plotter cut of a label media, the method comprising: providing a cutting assembly for plotter cutting the label media, the cutting assembly having frame, a force-generating mechanism connected to the frame, and a plotter cutter connected to the force-generating mechanism; supplying the label media to be plotter cut using the plotter cutter; providing a memory device for electronic communication with the cutting assembly, the memory device having a label media-specific value stored thereon, the label media-specific value corresponding to a label media-specific cutting force; reading the label media-specific value corresponding to a label media-specific cutting force from the memory device; converting the label media-specific value corresponding to a label media-specific cutting force to a label media-specific current signal; providing, based on the label media-specific current signal, a label media-specific current; applying the label media-specific current to the force-generating mechanism; generating, at the force-generating mechanism, the label media-specific cutting force based on the label media-specific current applied to the force-generating mechanism; transferring the label media-specific cutting force generated at the force-generating mechanism so that the plotter cutter will be controlled to plotter cut the label media at a label media-specific cutting depth; and plotter cutting the label media at the label media-specific cutting depth, thereby making a media-specific plotter cut on the label media.

Various other aspects, features, objects and advantages of the present invention will be made apparent from the following detailed description and the drawings.

BRIEF DESCRIPTION OF DRAWINGS

Preferred embodiments of the invention are described below with reference to the following drawings, which are provided for illustrative purposes only. The drawings illustrate a best mode presently contemplated for carrying out the invention.

In the drawings.

DETAILED DESCRIPTION OF THE PREFERRED EMBODIMENT

In the following detailed description, references are made to the accompanying drawings which form a part of this application, and in which is shown by way of illustration specific embodiments in which the invention can be practiced. These embodiments are described in sufficient detail to enable those skilled in the art to practice the invention, and it is to be understood that other embodiments can be utilized and that various changes can be made without departing from the spirit and scope of the present invention. Moreover, in the detailed description, like numerals are employed to designate like parts throughout the same. Various items of equipment, such as fasteners, fittings, etc., in addition to various other elements and specific principles of their operation, are omitted to simplify the description. However, those skilled in the art will realize that such conventional equipment and principles of operation can be employed as desired. Locations of various of the components, including those components shown and described herein, can be varied as desired or as the applications warrant.

Figure 1:
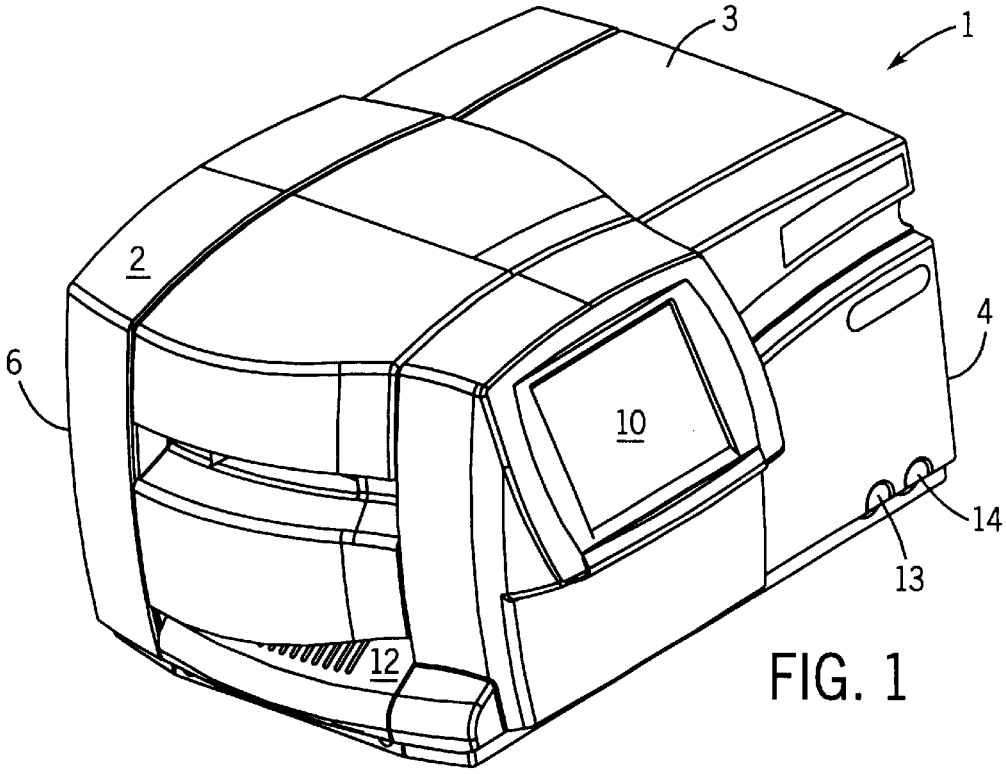
FIG. 1 is a perspective view of a label printer that can employ a label printer cutting assembly according to one aspect of the present invention.
Figure 2:
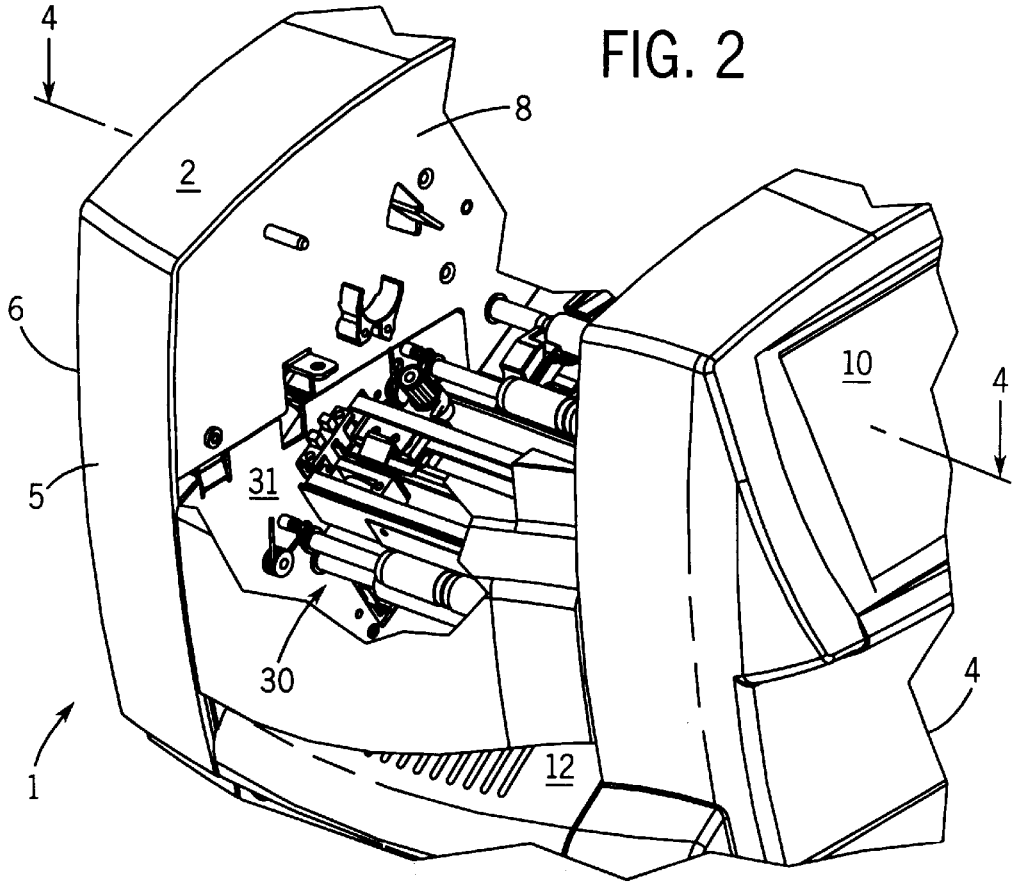
FIG. 2 is a perspective, cutaway view of a portion of the label printer of FIG. 1 with the interior of the printer partially exposed.

Shown in FIGS. 1–2, is label printer 1. In a preferred embodiment, printer 1 can accomplish both printing and cutting operations in a single unit, and thus, label printer 1 can also be referred to as a "label printer-cutter". Printer 1 includes a plastic housing 2 having a front 4, a back (not shown), a left side 6 and a right side (not shown). Printer 1 includes a cover portion 3 and a base portion 5 (FIG. 2). In FIG. 1, the cover portion is closed, and so printer 1 is shown in a configuration that is suitable for, for example, operation or transport. Cover portion 3 can be raised or opened to access the interior of printer 1. Cover portion 3 can also be raised, for example, when the printer is in an idle state, or a state suitable for loading and/or unloading a label media. Cover portion 3 can be raised by releasing a temporary securing mechanism (not shown) on left side 6 of housing 2 and applying a lifting force to the cover portion. Housing 2 supports LCD screen 10 that may be pivotally mounted to housing front 4. Printed labels (not shown) are ejected from printer 1 via exit chute 12 formed in housing side 6. LCD screen 10 can display, among other things, printer status and error indicators to a user of printer 1. First adjustment mechanism 13 (FIG. 1) can be included, for example, to control and/or adjust LCD screen 10 brightness. Other parameters, such as print or color intensity of an output label, can also be adjusted, for example, by second adjustment mechanism 14.

FIG. 2 shows a cutaway view of a portion of label printer 1. Housing 2 encloses various printer assemblies (some of which are not detailed herein to facilitate understanding of the invention), and these assemblies can be mounted to frame 8. For example, cutting assembly 30 is attached to cutter assembly frame 31, with frame 31 secured to frame 8.

Label printer assemblies (e.g., cutter assembly 30) and LCD screen 10 are controlled by printer circuitry. Housing 2 of label printer 1 can be manufactured, along with its various assemblies, according to known manufacturing principles (e.g., injection molding) and using known materials (e.g., plastic, metal, and the like).

Although not shown, it is contemplated that printer 1 can be connected to, and usable with, a data entry device, such as a keyboard, for entering alpha-numeric information necessary for preparation and design of a desired output. Printer 1 can include firmware (e.g., software designed on a platform such as Windows CE™), available from Microsoft and software for controlling, in whole or in part, various printer assemblies, among them cutting assembly 30. Frame 8 can be designed to hold programmable memory devices known as flash cards that can be used to store firmware and software routines. Flash cards are typically used during product development to facilitate updates to the firmware and other software. Flash cards can be replaced by permanently programmed memory chips. Using the above-described firmware and software and the associated memory devices, printer assemblies such as cutter assembly 30 can be activated and controlled in an automated fashion.

Figure 3:
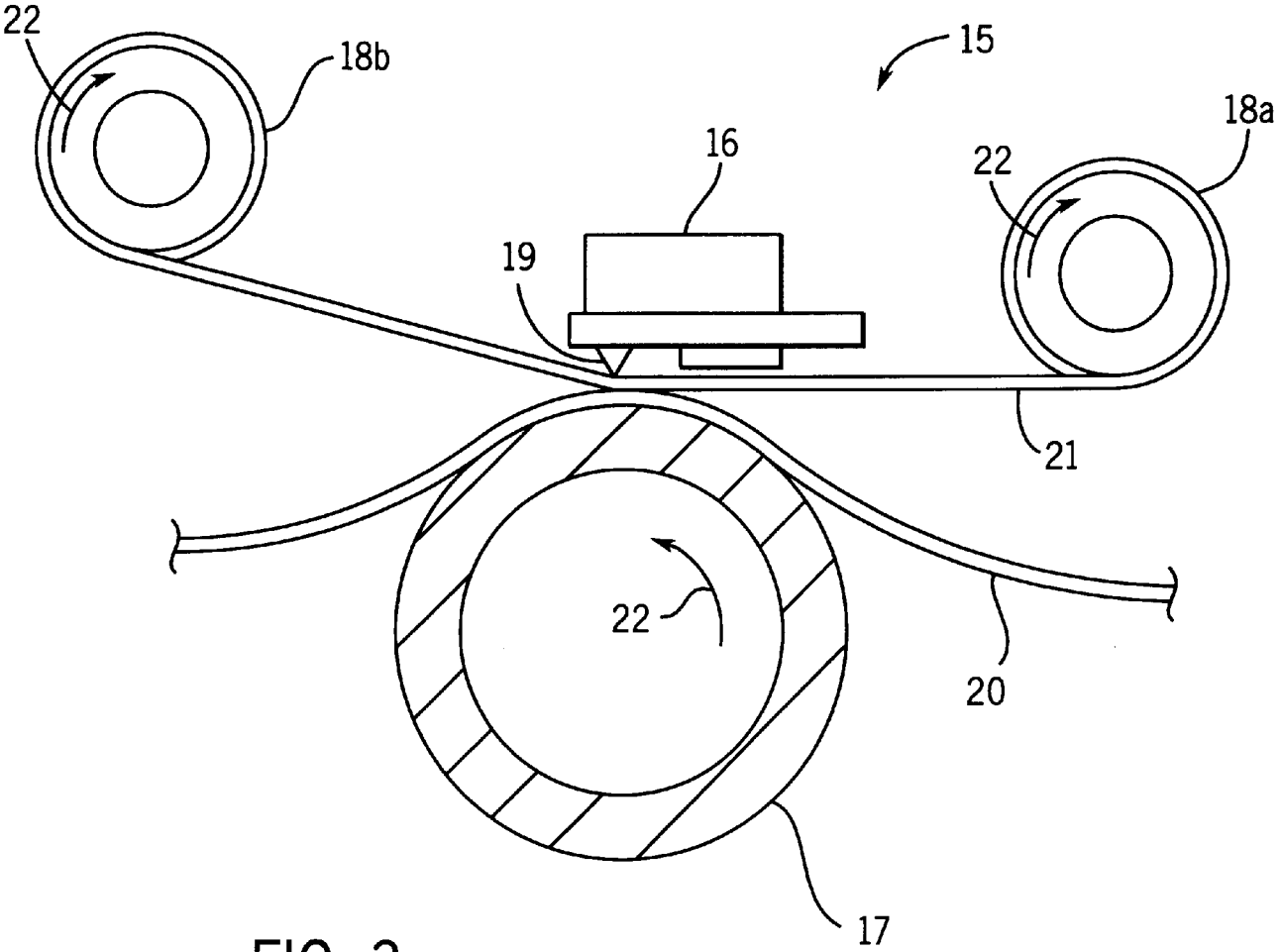
FIG. 3 is a schematic illustration of one embodiment of a printing arrangement that can be used with the printer of FIG. 1.

A typical thermal printing arrangement 15 is illustrated schematically in FIG. 3 since, in a preferred embodiment, the label printer of FIG. 1 can be a thermal label printer. Printing arrangement 15 includes print head 16, support (platen) roller 17, label media delivery roller 18*a*, and label media take-up roller 18*b*. Label media delivery and take-up rollers 18*a,b* can be separate components, or alternatively, they can be housed within a unitary structure (e.g., a label media supply cartridge). Print head 16 is typically equipped with a linear array of thermal elements 19. The number of thermal elements 19 in the linear array can vary, with a characteristic print head 16 employing one thousand two hundred forty-eight (1,248) thermal elements 19. Thermal elements 19 produce heat in response to energy supplied to print head 16. A current is applied to thermal elements 19 to heat the thermal elements 19 to a level sufficient to transfer dots onto label media 20. This occurs when a thermally-sensitive supply 21 (e.g., an ink ribbon) comes into thermal contact with the thermal elements 19. Printing arrangement 15 includes thermally-sensitive supply delivery roller 22*a*, and thermally-sensitive take-up roller 22*b*. Thermally-sensitive supply delivery and take-up rollers 22*a,b* can be separate components, or alternatively, they can be housed within a unitary structure (e.g., an ink ribbon cartridge). It is contemplated that color printing can be accomplished as well as black (along with shades of gray). Directional arrows 23 indicate the direction of travel of platen roller 17, label media delivery and take-up rollers 18*a,b* and thermally-sensitive supply delivery and take-up rollers 22*a,b* in printing arrangement 15.

Figure 4:
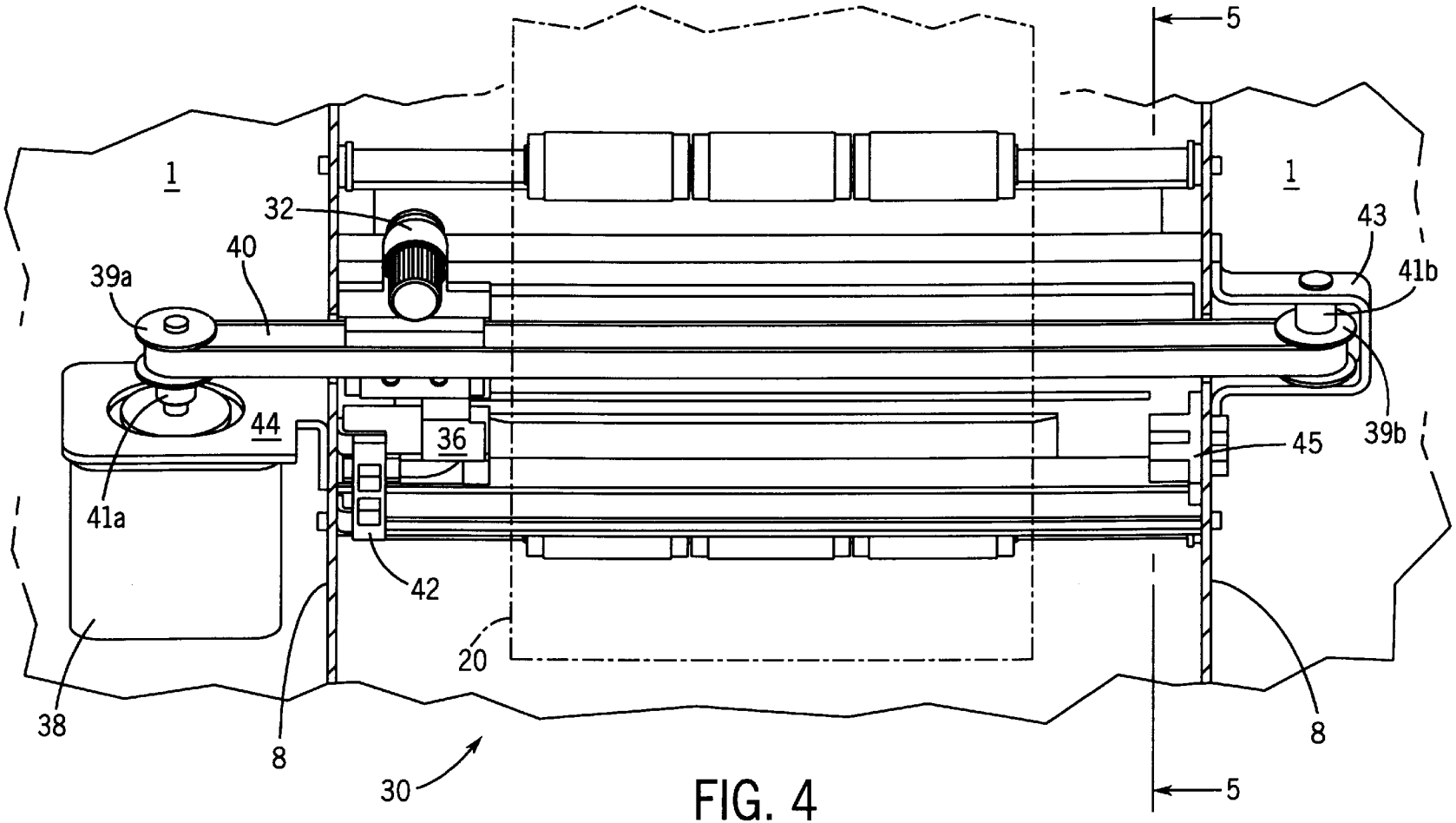
FIG. 4 is an angled perspective view taken along line 4—4 of FIG. 2 illustrating one embodiment of a label printer cutting assembly according to one aspect of the present invention.

Referring to FIG. 4, an enlarged cross-sectional view taken along line 4—4 of FIG. 2 illustrating one embodiment of label printer cutting assembly 30 connected to frame 31 of printer 1 is shown according to one aspect of the present invention. Cutting assembly 30 includes a plotter cutter 32 to effectuate plotter cutting of label media 20 (shown in phantom) to form one or more discrete labels. The cutting assembly further includes end cutter 36 to effect end cutting (also called "shear cutting" or "cutting off") of a label media. It will be recognized that end cutting can take place with or without plotter cutting of the label media having first taken place. Cutting assembly 30 is generally driven using a drive mechanism, here shown as step motor 38. The manner in which cutting assembly 30 is driven is described in greater detail with reference to various figures below, but it is noted that belt 40 is a timing belt that is used generally to effectuate proper cutting of label media 20 via the cutting assembly. As shown, timing belt 40 is driven by step motor 38 via pulleys 39*a,b* that are connected to shafts 41*a,b*, respectively, with shaft 41*a* connected to step motor 38 and shaft 41*b* connected to bracket 43. Bracket 43 is connected to frame 31. Step motor 38 is also connected to frame 31 by bracket 44. As shown, in a preferred embodiment, end cutter home sensor 42 and plotter cutter home sensor 45 are included in the cutting assembly connected to frame 31. Sensor 42 is used to determine when end cutter 36 has reached, or is located at, a home or rest position. Similarly, sensor 45 is used to determine when plotter cutter 32 has reached, or is located at, a home or rest position. As a practical matter, the home or rest position for the end cutter (and similarly for the plotter cutter) can be reversed, or at any convenient location within frame 31, since the firmware and/or software associated with the label printer can accommodate such positional variation.

Figure 5:
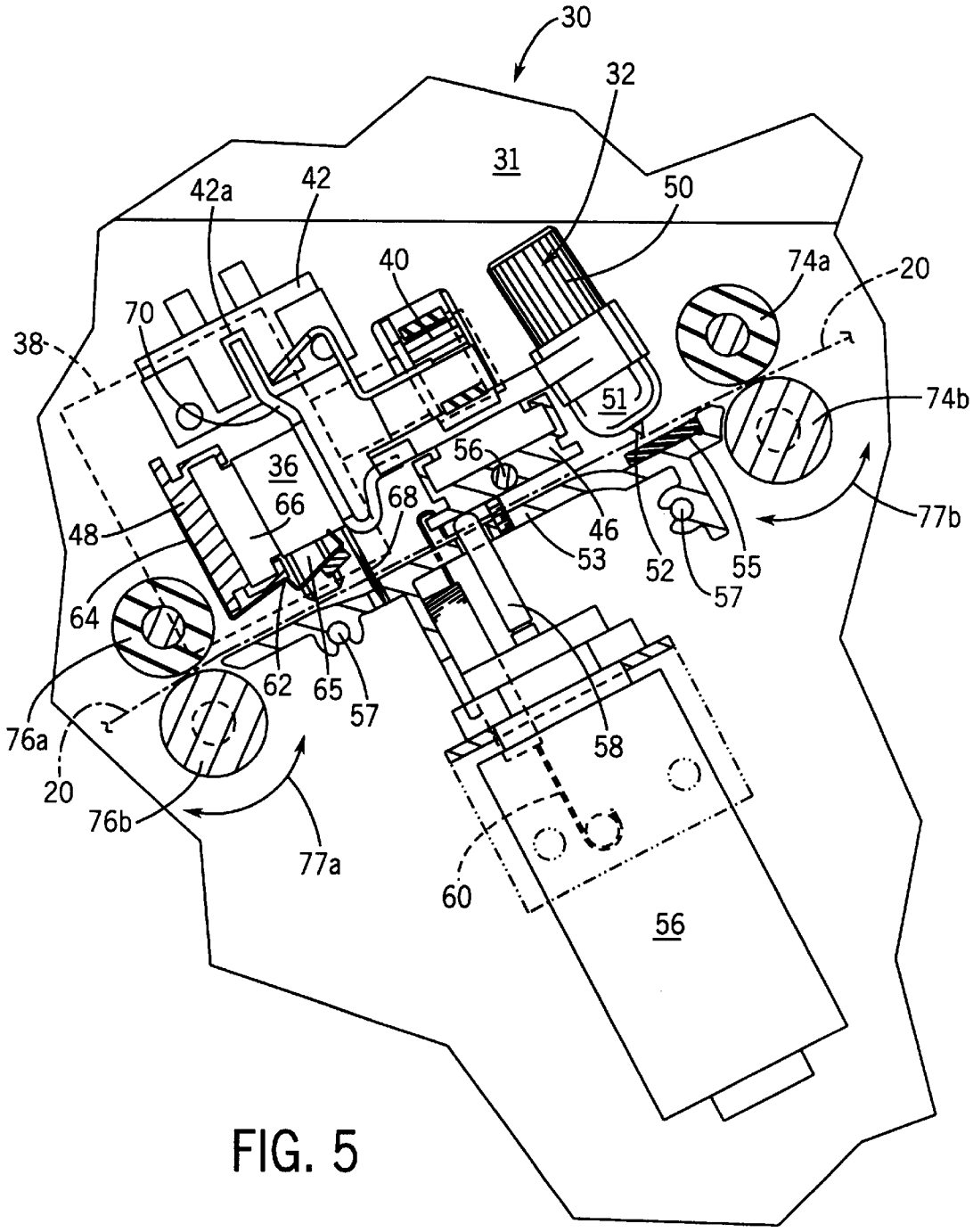
FIG. 5 shows an enlarged cross-sectional view taken along line 5—5 of FIG. 4.

Referring to FIG. 5, an enlarged detailed cross-sectional view of a portion of FIG. 4 is shown illustrating one embodiment of cutting assembly 30. Cutting assembly 30 includes plotter cutter 32 and end cutter 36. Plotter cutter 32 comprises knob 50 and a plotter cutter pin blade 52. Knob 50 is used to adjust plotter cutter cutting depth, such as an initial cutting depth of plotter cutter cutting pin blade 52. The initial blade cutting depth (i.e., blade protrusion) may be measured and set to a specific value at the time of label printer manufacture. Knob 50 adjusts cutting depth via connecting section or nose 51, and the depth is adjusted with respect to label media 20. Label media 20 rides on label support 53, which is connected to frame 31 of label printer 1, here via connections 57. Label cutting pad 55 can be included below pin blade 52 between label media 20 and label support 53. Cutting pad 55 protects pin blade 52 so as to increase pin blade cutting life. Cutting pad 55 is typically made from materials such as nylon or delrin (acetal).

Still referring to FIG. 5, plotter cutter 32 engages and slides along plotter cutter slide rail 46 and end cutter 36 engages and slides along end cutter slide rail 48. End cutter slide 48 rail is fixedly mounted to cutter assembly frame 31. End cutter 36 comprises clamp 64 and clamp wheel 65 to permit the end cutter to slidably engage end cutter slide rail 48 via extension 66. End cutter 36 further comprises cutter blade 68 to accomplish cutting off or shear cutting of label media 20. Plotter cutter slide rail 46 is pivotally mounted to cutter assembly frame 31 via pivot 54 (e.g., a pin, screw or other rotation-permitting connector). A solenoid 56, or other force-generating mechanism (e.g., a motor and lever mechanism), is connected to plotter cutter slide rail 46 via a connection or armature 58. Rollers 74*a,b* and 76*a,b* rotate and serve to position label media 20 in cutting assembly 30 for cutting. Rollers 74*a* and 76*a* rotate in the same direction (i.e., clockwise or counterclockwise) and rollers 74*b* and 76*b* will both corresponding rotate in an opposite direction to rollers 74*a* and 76*a*. End cutter home sensor 42 senses when end cutter extension or flag 70 activates (e.g., using an optical sensing technology) the sensor via end cutter home sensor slot 42*a*. Belt 40 drives plotter cutter 32 and end cutter 36 to effect proper cutting of label media 20 in cutting assembly 30.

Figure 6:
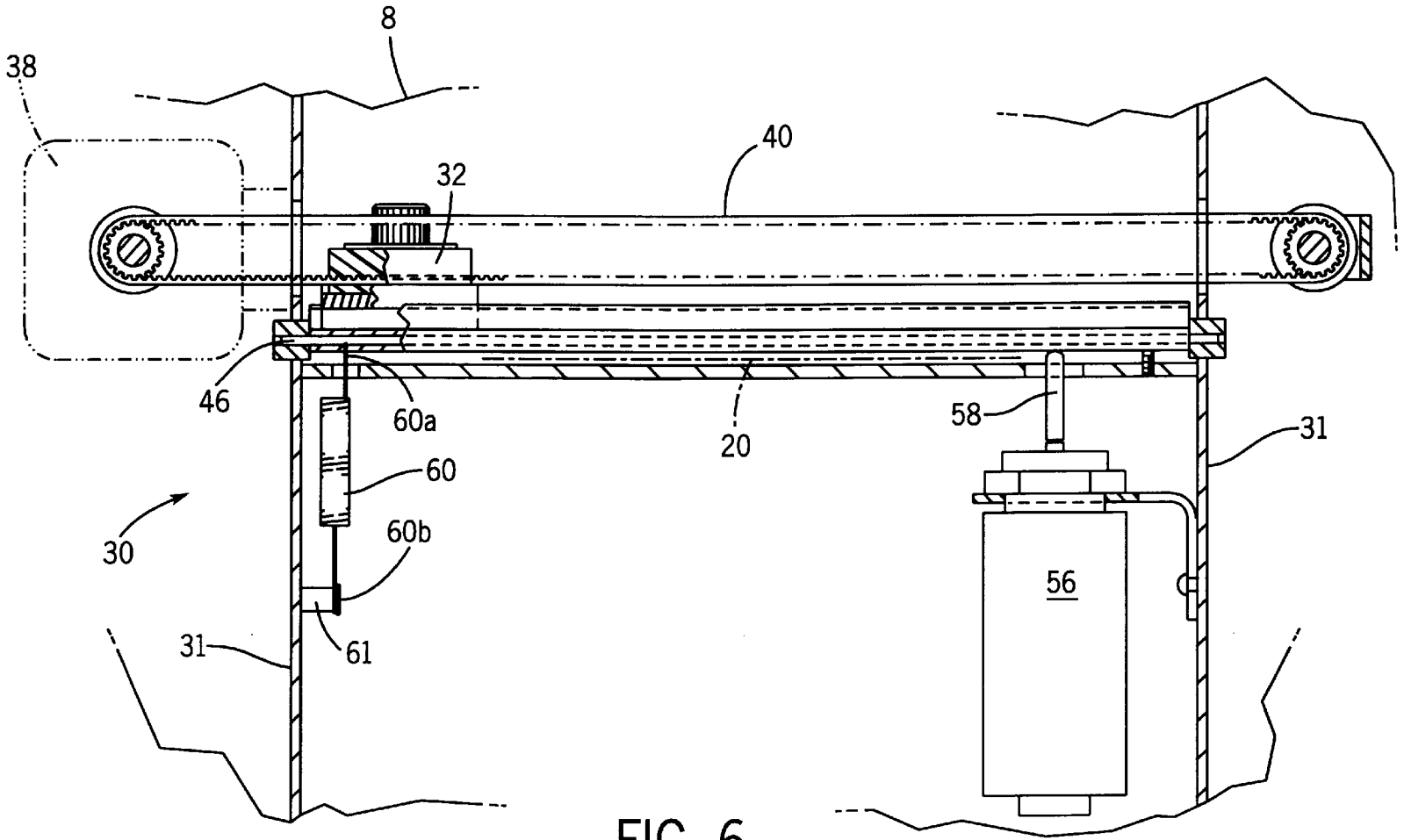
FIG. 6 illustrates a cross-sectional view taken along line 6—6 of FIG. 4.

FIG. 6 illustrates a cross-sectional view taken along line 6—6 of FIG. 4. More specifically, FIG. 6 shows one embodiment of plotter cutter 32 in a label printer cutting assembly 30. Cutting assembly 30 is connected to a cutter frame 31 which is secured, as noted above, to frame 8. Plotter cutter 32 is used to effect cutting of a label media 20 to form one or more discrete labels. Again, plotter cutter 32, as noted above, is generally carried by timing belt 40, which is driven by step motor 38 (shown in phantom). Solenoid 56, or other force-generating mechanism, is secured to frame 31 in a conventional manner. Solenoid 56 is also attached, via connection or armature 58, to plotter cutter slide rail 46. Spring 60 is shown and includes an upper end 60*a* and a lower end 60*b*. Spring 60 attached at lower end 60*b* to cutter frame 31 via anchor 61. Spring 60 is attached at its upper end to plotter cutter slide rail 46.

Cutting assembly 30 is more fully described in a co-pending U.S. patent application entitled "Label Printer End and Plotter Cutting Assembly" filed concurrently herewith and which is fully incorporated herein by reference.

Figure 7:
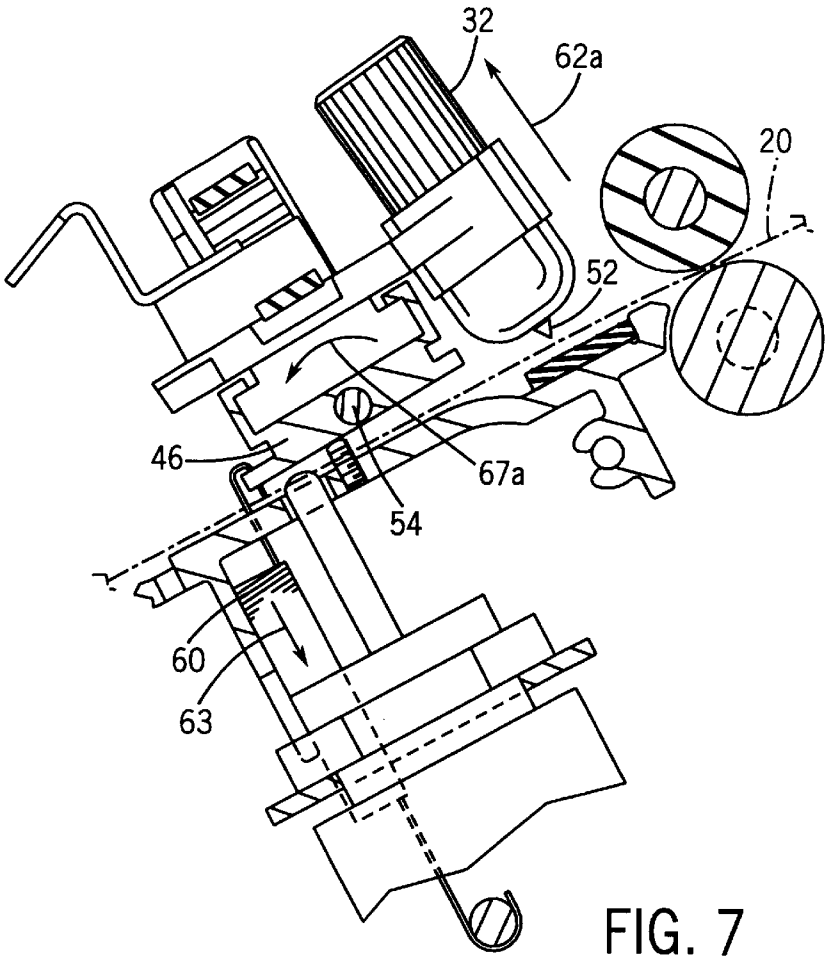
FIG. 7 shows an enlarged cross-sectional view taken along line 7—7 of FIG. 6 illustrating one embodiment of the label printer cutting assembly where the plotter cutter is in a raised position off of a label media.

Referring to FIG. 7, plotter cutter 32 is shown in a rest position (i.e., a position in which plotter cutting does not take place). Compressive force of spring 60, indicated by arrow 63, rotates plotter cutter slide rail 46 about pivot 54, with the rotation about the pivot indicated by arrow 67*a*. Accordingly, plotter cutter 32 and its blade 52 are lifted, as indicated by arrow 62*a*, off of label media 20 when plotter cutting is not taking place.

Figure 8:
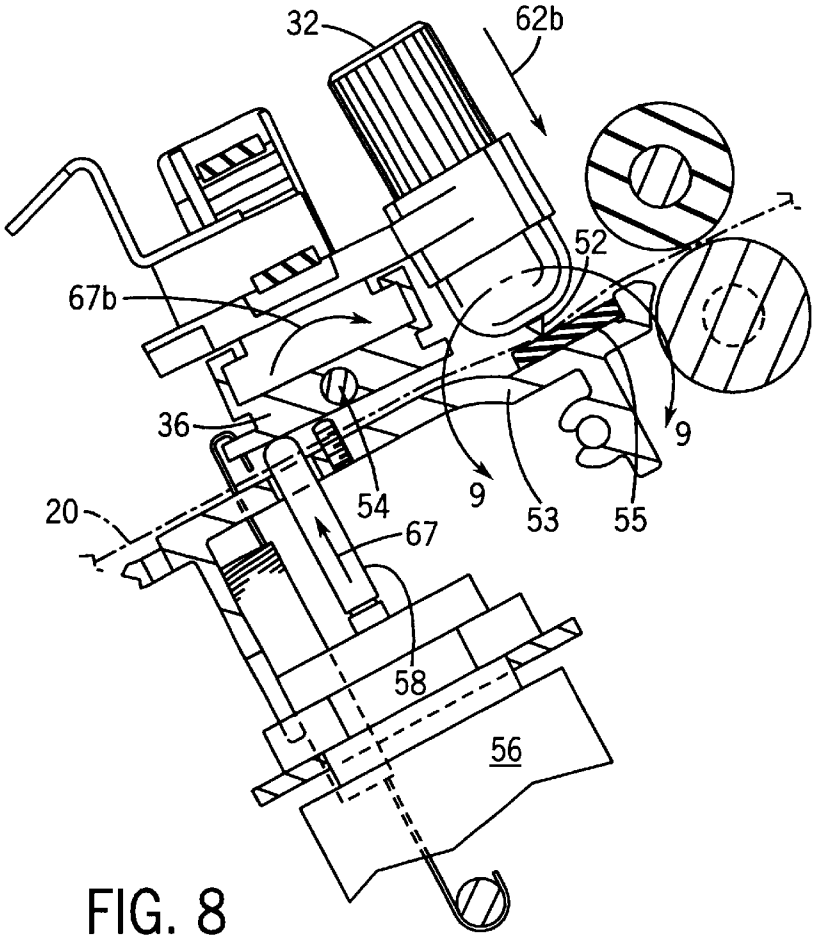
FIG. 8 shows an enlarged cross-sectional view taken along line 8—8 of FIG. 6 illustrating one embodiment of the label printer cutting assembly where the plotter cutter is in a position lowered onto the label media.

FIG. 8 generally shows the plotter cutter 32 in a plotter cutting position, that is, a position to effect plotter cutting of label media 20 into discrete labels. Solenoid 56 imparts a force to move armature 58 upwardly, indicated by arrow 67. The solenoid force overcomes the compressive force of spring 60 (FIG. 7), thereby extending the spring in tension, so as to rotate or tilt plotter cutter slide rail 46 about pivot 54, indicated by arrow 67*b*. As a result, plotter cutter 32 is lowered, along with its blade 52, downwardly, into contact with label media 20. The downward motion of plotter cutter 32 is indicated by arrow 62*b*. Plotter cutter 32 is thus placed in a plotter cutting position to cut label media 20, with the position located generally over cutting pad 55.

Figure 9:
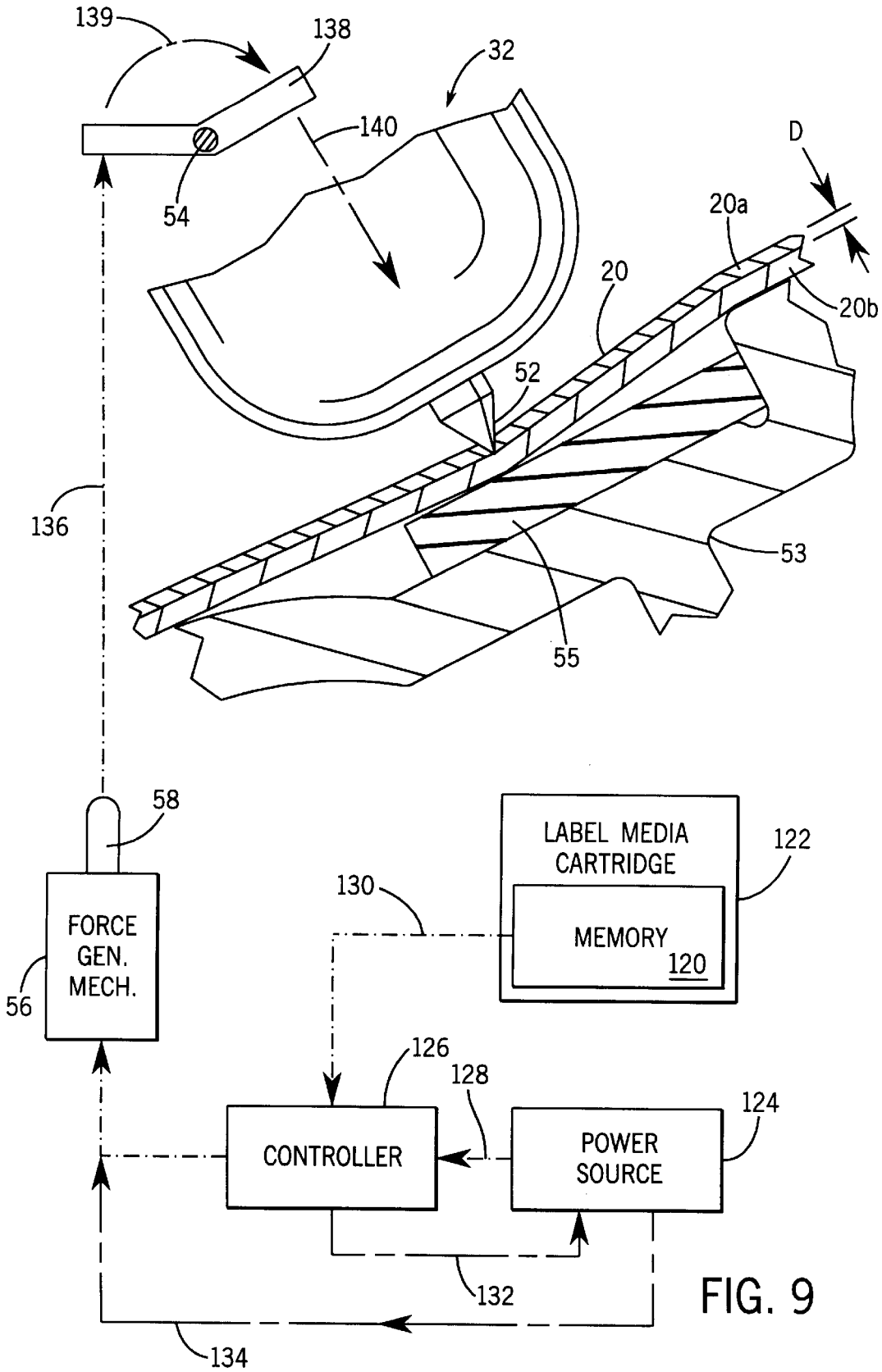
FIG. 9 is a partially schematic cross-sectional view taken along line 9—9 of FIG. 8 illustrating operation of the plotter cutter in accordance with one aspect of the invention.

FIG. 9 shows an enlarged cross-sectional view taken along line 9—9 of FIG. 8 as well as a partially schematic representation of the operation of plotter cutter 32 imparting a plotter cut on label media 20 in accordance with one aspect of the present invention. Specifically, plotter cutter 32 cuts, blade 52, label media 20 over cutting pad 55 disposed on label support 53.

The types of label media stored in a label media cartridge can vary. As a result, the force necessary to cut a specific label media will vary with that specific media. A memory device (e.g., a memory chip, or referred to simply as "memory") 120 can be associated with, or attached to, a label media supply cartridge 122. In this manner, the force necessary to cut label media (i.e., label media-specific cutting force) can be stored on a memory device attached, for example, to the cartridge holding that same label media. As a practical matter, memory device 120 can store label media specific cutting force value(s) directly, or as value(s) representative of the cutting force. Memory device 120 can alternatively store values thereon from which the force can be derived. The values stored on the memory device can be current-proportional values that are representative of the media-specific cutting force. In general, it is well understood that memory devices store data. Values can be stored in a memory device in any form that can be read and processed by electronic devices to which the memory device may be connected.

A power source 124 is used to provide, via an electrical connection 128, power to controller 126. An electrical connection 130 can be established between memory device 120 and label printer controller 126. By this connection, controller 126 can read or otherwise obtain from memory device 120 the values or data stored on the device that are representative of the media-specific cutting force. In one embodiment, the values are dimensionless values that can be read and processed by label printer controller 126. The controller can convert, using computerized instructions programmed therein, the label media-specific value(s) into corresponding, media-specific current signal(s).

A media-specific current can be provided by power source 124 based on the media-specific current signal supplied by controller 126 to the power source, as illustrated, via electrical connection 132. The media specific current can then be applied to force-generating mechanism 56 (e.g., a solenoid), via an electrical connection 134. The current is preferably between 0 and 1 amp, and more preferably about 0.5 amp.

In general, force-generating mechanism 56 will provide a force that is proportional to the current applied to it. Therefore, at force-generating mechanism 56, a media-specific cutting force can be generated based on the applied label specific current. In a preferred embodiment, the force-generating mechanism includes armature 58 that applies a media-specific cutting force to plotter cutter 32. Armature 58 is responsible for imparting the media-specific cutting force to plotter cutter 32 through various intermediate physical connections, all of which are shown schematically as dashed line and arrow 136 and portion 138. In a preferred embodiment, illustrative physical connections include, among other items, cutter pivot 54, to transfer the media-specific cutting force, illustrated by arrow 140, either directly or indirectly, to plotter cutter 32 via, for example, a rotational movement, indicated by arrow 139.

Using the media-specific cutting force 140 applied from force-generating mechanism 56, a label media-specific plotter cut can be made. "Label media-specific plotter cut" means plotter cutting of a label media at a media-specific cutting depth, denoted in FIG. 9 as "D".

Label media 20 includes tape layer 20*a*, an adhesive layer (not shown), such that the tape is releasably attached to release or substrate layer 20*b*. Again, plotter cutting, as here used and shown, results in cutting label media tape layer 20*a* (along with the adhesive layer). Release or substrate layer 20*b* is not cut or substantially cut via plotter cutting of plotter cutter 32. Accordingly, media-specific plotter cutting depth "D" can generally correspond to the thickness of tape layer 20*a*.

Some label media materials will require a lesser cutting force than others to achieve cutting depth "D". A lesser cutting force necessarily will require less current, and therefore, less energy. Accordingly, an energy savings can be realized using the present invention. Perhaps even more significantly, because the force transferred by the force-generating mechanism will correspond to a specific cutting depth, a plotter cutter blade need not be manually adjusted for each specific label media that is desired to be cut.

Label material (e.g., plastic, vinyl, etc.) and dimension (e.g., height, width, thickness) can vary from one label-making run to another. Since each media cartridge housing a given label material can be provided with an operably-associated memory device, each media cartridge can be said to be equipped with its own label media depth "pre-programmed" into the memory device associated with the cartridge. In this fashion, plotter cutter cutting depth can be controlled in a fashion that results in repeatable, accurate, and label media-specific plotter cuts.

Figure 10:
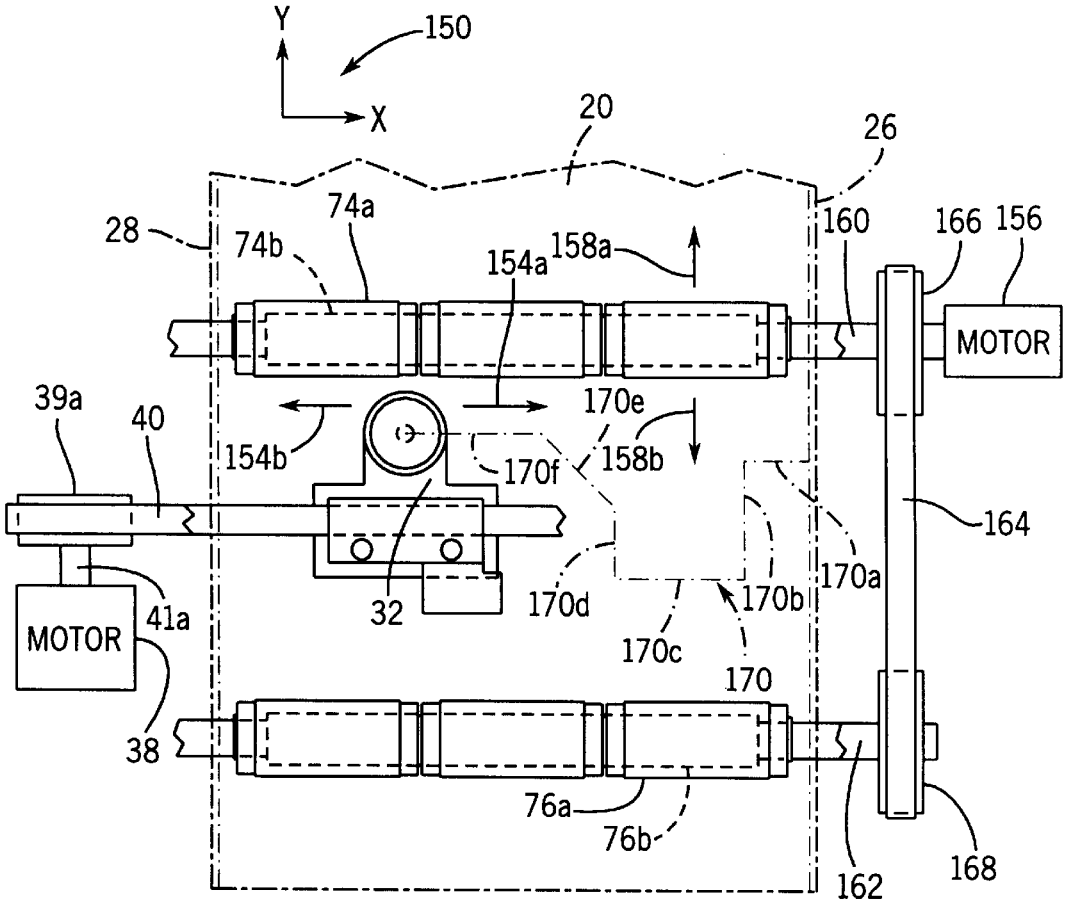
FIG. 10 shows a top, partially schematic view of the cutting assembly plotter cutter accomplishing a plotter cutting sequence in accordance with one aspect of the present invention.

FIG. 10 shows a top, partially schematic view of plotter cutter 32 accomplishing a plotter cutting sequence along a cutting path 170 in accordance with one aspect of the present invention. Cutting path 170 is representative of a plotter cut that has already taken place. Cartesian coordinates 150 are included for clarification purposes. Plotter cutter 32 is driven, as noted previously, by a drive mechanism, such as step motor 38, via shaft 41*a* connected via pulley 39*a* to belt 40. Plotter cutter 32, as shown, can move in both positive and negative x directions, as indicated by arrows 154*a* and

154*b*, respectively. Label media 20 is driven by a drive mechanism, such as step motor 156. Motor 156 drives label media 20 in a positive or negative y direction, indicated by arrows 158*a* and 158*b*, via driving rollers 74*b* and 76*b* (shown in phantom). Specifically, rollers 74*b* and 76*b* are connected to step motor 156 via shafts 160 and 162. Belt 164 and pulleys 166, 168 permit step motor 156 to drive both rollers 74*b* and 76*b*. Rollers 74*a* and 76*a*, as shown, are pinch or passive rollers.

Plotter cutter 32 is shown having traversed, from a right edge 26 to a left edge 28, of label media 20 in a negative x direction to create cutting path 170. During the cutting operation that has taken place to institute a plotter cut along path 170, label media 20 has been moved in both positive and negative y directions.

More specifically, cutting path 170 includes cutting path portions 170*a–f*, where each of the portions corresponds to plotter cutter 32 and/or label media 20 movement as follows: portion 170*a* corresponds to negative x cutting by plotter cutter 32 while label media 20 remains stationary; portion 170*b* corresponds to positive y movement of label media 20 while plotter cutter 32 cuts, but remains stationary; portion 170*c* corresponds to negative x cutting by plotter cutter 32 while label media 20 remains stationary; portion 170*d* corresponds to negative y movement of the label media 20 while plotter cutter 32 cuts, but remains stationary; portion 170*e* corresponds to negative x cutting by plotter cutter 32, as well as negative y movement of label media 20; and portion 170*f* corresponds to negative x cutting by plotter cutter 32 while label media 20 remains stationary.

While a particular preferred embodiment has been shown and described above, it is apparent that the teachings of this invention may be applied utilizing other hardware performing the same or equivalent functions. It is contemplated that cartridges for holding and/or supplying one or both of the ribbon and/or label media supplies can be of the "re-usable" (also called "refillable") type, but preferably are of the "disposable" type.

Methods have been described and outlined in a sequential fashion. Still, elimination, modification, rearrangement, combination, reordering, or the like, of the methods is contemplated and considered within the scope of the appending claims.

In general, while the present invention has been described in terms of preferred embodiments, it is recognized that equivalents, alternatives, and modifications, aside from those expressly stated, are possible and within the scope of the appending claims.

What is claimed is:

1. In a label printer-cutter, a method for controlling plotter cutting of a label media at a label media-specific cutting depth, the method comprising:

providing a cutting assembly for plotter cutting the label media in the label printer-cutter, the cutting assembly having a frame, a solenoid connected to the frame, and a plotter cutter connected to the solenoid;

providing a memory chip for electronic communication with the cutting assembly, the memory chip having a label media-specific value stored thereon, the label media-specific force value corresponding to a label media-specific cutting force;

reading the label media-specific value from the memory chip;

converting the label media-specific value to a label media-specific current signal;

providing, based on the label media-specific current signal, a label media-specific current;

applying the label media-specific current to the solenoid;

generating, with the solenoid, the label media-specific cutting force based on the label media-specific current applied to the solenoid; and transferring, to the plotter cutter, the label media-specific cutting force generated at the solenoid so that the plotter cutter will be controlled to plotter cut the label media of the label printer-cutter at the label media-specific cutting depth.

2. The method of claim 1 further comprising at least one of, with a controller that is in electronic communication with the cutting assembly, reading the label media-specific value, converting the label media-specific value, providing the label media-specific current, and applying the label-media specific current.

3. The method of claim 1 wherein the cutting assembly includes an end cutter connected to the cutting assembly.

4. The method of claim 1 wherein the label media-specific current applied to the solenoid is between about 0 and about 1 amp.

5. The method of claim 1 wherein the memory chip is attached to a label media supply cartridge for use with the label printer-cutter.

6. The method of claim 1 wherein transferring the label media-specific cutting force generated at the solenoid to the plotter cutter is accomplished via intermediate physical connections between the solenoid and the plotter cutter.

7. A method for controlling plotter cutting of a label media at a label media-specific cutting depth, the method comprising:

providing a cutting assembly for plotter cutting the label media, the cutting assembly including a frame, a force-generating mechanism connected to the frame, and a plotter cutter connected to the force-generating mechanism;

providing a memory device for electronic communication with the cutting assembly, the memory device having a label media-specific value stored thereon, the label media-specific value corresponding to a label media-specific cutting force;

reading the label media-specific value corresponding to the label media-specific cutting force from the memory device;

converting the label media-specific value corresponding to a label media-specific cutting force to a label media-specific current signal;

providing, based on the label media-specific current signal, a label media-specific current;

applying the label media-specific current based on the label media-specific current signal to the force-generating mechanism;

generating, at the force-generating mechanism, the label media-specific cutting force based on the label media-specific current applied to the force-generating mechanism; and transferring the label media-specific cutting force generated at the force-generating mechanism so that the plotter cutter will be controlled to plotter cut the label media at the label media-specific cutting depth.

8. The method of claim 7 wherein the cutting assembly is connected to a label printer cutter.

9. The method of claim 7 wherein the force-generating mechanism is a solenoid.

10. The method of claim 7 further comprising at least one of, with a controller that is in electronic communication with the cutting assembly, reading the label media-specific value corresponding to the label media-specific cutting force from the memory device, converting the label media-specific value corresponding to the label media-specific cutting force to the label media-specific current signal, providing, based on the label media-specific current signal, the label media-specific current, and applying the label-media specific current, based on the label media-specific current signal, to the force-generating mechanism.

11. The method of claim 7 wherein the memory device is attached to a label media supply cartridge for supplying a label media to the cutting assembly.

12. The method of claim 7 wherein transferring the label media-specific cutting force generated at the force-generating mechanism to the plotter is accomplished via a cutter pivot that is connected to the force-generating mechanism and the plotter cutter.

13. A method for making a media-specific plotter cut of a label media, the method comprising:

providing a cutting assembly for plotter cutting the label media, the cutting assembly having a frame, a force-generating mechanism connected to the frame, and a plotter cutter connected to the force-generating mechanism;

supplying the label media to be plotter cut using the plotter cutter;

providing a memory device for electronic communication with the cutting assembly, the memory device having a label media-specific value stored thereon, the label media-specific value corresponding to a label media-specific cutting force;

reading the label media-specific value corresponding to a label media-specific cutting force from the memory device;

converting the label media-specific value corresponding to a label media-specific cutting force to a label media-specific current signal;

providing, based on the label media-specific current signal, a label media-specific current;

applying the label media-specific current to the force-generating mechanism; generating, at the force-generating mechanism, the label media-specific cutting force based on the label media-specific current applied to the force-generating mechanism;

transferring the label media-specific cutting force generated at the force-generating mechanism so that the plotter cutter will be controlled to plotter cut the label media at a label media-specific cutting depth; and plotter cutting the label media at the label media-specific cutting depth, making a media-specific plotter cut on the label media.

14. The method of claim 13 further comprising at least one of, with a controller that is in electronic communication with the cutting assembly, reading the label media-specific value corresponding to the label media-specific cutting force from the memory device, converting the label media-specific value corresponding to the label media-specific cutting force to the label media-specific current signal, providing, based on the label media-specific current signal, the label media-specific current, and applying the label-media specific current, based on the label media-specific current signal, to the force-generating mechanism.

15. The method of claim 13 wherein the force-generating mechanism is a solenoid.

16. The method of claim 13 wherein the label media is supplied via a label media supply cartridge.

17. The method of claim 16 wherein the memory device is attached to the label media supply cartridge for electronic association with the cutting assembly.

18. The method of claim 13 wherein transferring the force generated at the force-generating mechanism is accomplished via intermediate physical connections that are connected to the force-generating mechanism and the cutting assembly.

19. A method for plotter cutting a label media at a label media-specific cutting depth, the method comprising:

providing a cutting assembly for plotter cutting the label media, the cutting assembly having a frame, a force-generating mechanism connected to the frame, and a plotter cutter connected to the force-generating mechanism;

supplying the label media to be plotter cut using the plotter cutter;

providing a memory device associated with the label media, the memory device in electronic communication with the cutting assembly, the memory device having a label media-specific force value stored thereon, the label media-specific force value corresponding to a label media-specific cutting force;

reading the label media-specific force value corresponding to a label media-specific cutting force from the memory device;

converting the label media-specific force value corresponding to a label media-specific cutting force to a label media-specific current signal;

providing, at a power source, a label media-specific current, the current based on the label media specific force value stored on the memory device associated with the label media;

applying the label media-specific current to the force-generating mechanism; generating, at the force-generating mechanism, the label media-specific cutting force based on the label media-specific current applied to the force-generating mechanism;

transferring the label media-specific cutting force generated at the force-generating mechanism to the plotter cutter so that the plotter cutter will be controlled to effect plotter cutting of the label media at a label media-specific cutting depth; and plotter cutting the label media at the label media-specific cutting depth, making the media-specific plotter cut.

20. The method of claim 19 wherein plotter cutting the label media takes place along a defined plotter cutter cutting path.

21. The method of claim 19 wherein the force-generating mechanism is a solenoid.

22. The method of claim 19 wherein the current applied to the force-generating mechanism is about 0.5 amp.

23. The method of claim 19 wherein the memory device is attached to a label media supply cartridge for use with the label printer-cutter.

24. The method of claim 19 wherein transferring step the force generated at the force-generating mechanism is accomplished via a cutter pivot that is connectably engaged with the force-generating mechanism and the cutting assembly.

25. A system for controlling plotter cutting of a label media at a label media-specific cutting depth, the system comprising:

means for plotter cutting the label media;

means for storing a label media-specific value corresponding to a label media-specific cutting force, the storing means in electronic association with the label media plotter cutting means;

means for reading the label media-specific value corresponding to the label media-specific cutting force from the storing means;

means for converting the label media-specific value corresponding to the label media-specific cutting force to a label media-specific current signal;

means for providing, based on the label media-specific current signal, a label media-specific current;

means for applying the label media-specific current based on the label media-specific current signal to a force-generating means;

means for generating a label media-specific cutting force based on the label media-specific current applied to the force-generating means; and means for transferring the label media-specific cutting force generated at the force-generating means to the plotter cutting means so that the plotter cutting means is controlled when effecting a media-specific plotter cut on the label media at the label media-specific cutting depth.

26. The system of claim 25 wherein the plotter cutting means executes plotter cutting of the label media along a pre-defined plotter cutter cutting path.

27. The system of claim 25 further includes means for providing power.

28. The method of claim 25 wherein the storing means is attached to a means for supplying label media capable of being used with label printer-cutter.

29. The system of claim 28 wherein the storing means is a label media supply cartridge.

30. The method of claim 25 wherein the transferring means includes intermediate connection means in connection with the force-generating means and the cutting means.

31. A system for making a label media-specific plotter cut on a label media, the system comprising:

a plotter cutter for plotter cutting a label media at label media-specific plotter cutting depth, the label media supplied from a label media supply;

a memory device associated with the label media supply having a label media-specific value stored thereon;

a force-generating mechanism connected to the plotter cutter to provide a label media-specific cutting force;

a power source for generating a current to be sent to energize the force-generating mechanism; and a controller, the controller in operable association with the plotter cutter, the force-generating mechanism, and the power source;

wherein the label media-specific cutting force is generated at the force-generating mechanism based on the label media-specific value stored on the memory device; and wherein the label media-specific cutting force is transferred to the plotter cutter, the plotter cutter therefrom effecting the label media-specific plotter cut on the label media.

32. A method for reducing label media waste in a label media plotter cutting operation, the method comprising:

inserting, into a label printer-cutter, a label media supply cartridge having label media therein, the cartridge having a memory device associated therewith, the memory having stored thereon label media-specific data;

automatically varying a label media plotter cutting depth in response to a label media-specific cutting force, the label media-specific cutting force corresponding to the label media-specific data stored on the memory device associated with the label media cartridge inserted into the label printer-cutter, thereby reducing label media waste resulting from manual varying of the label media plotter cutting depth; and plotter cutting the label media at the label media-specific cutting depth.

* * * * *